US006219301B1

(12) United States Patent
Moriarty

(10) Patent No.: US 6,219,301 B1
(45) Date of Patent: Apr. 17, 2001

(54) PRESSURE PULSE GENERATOR FOR MEASUREMENT-WHILE-DRILLING SYSTEMS WHICH PRODUCES HIGH SIGNAL STRENGTH AND EXHIBITS HIGH RESISTANCE TO JAMMING

(75) Inventor: Keith A. Moriarty, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/176,085

(22) Filed: Oct. 20, 1998

Related U.S. Application Data

(60) Provisional application No. 60/066,643, filed on Nov. 18, 1997.

(51) Int. Cl.[7] ..... G01V 1/40

(52) U.S. Cl. ..... 367/84; 367/83; 367/85; 340/854.3; 175/48

(58) Field of Search ..... 367/83, 84, 85; 340/854.3; 175/40, 232, 48

(56) References Cited

U.S. PATENT DOCUMENTS

| | | | |
|---|---|---|---|
| Re. 29,734 | 8/1978 | Manning | 367/83 |
| 3,309,656 | 3/1967 | Godbey | 367/85 |
| 3,764,970 | 10/1973 | Manning | 367/83 |
| 4,847,815 | 7/1989 | Malone | 367/84 |
| 5,182,730 | 1/1993 | Scherbatskoy | 367/83 |
| 5,237,540 | 8/1993 | Malone | 367/81 |
| 5,249,161 | 9/1993 | Jones et al. | 367/83 |
| 5,375,098 | 12/1994 | Malone et al. | 367/83 |
| 5,583,827 | 12/1996 | Chin | 367/84 |

*Primary Examiner*—Michael Horabik
*Assistant Examiner*—Albert K. Wong
(74) *Attorney, Agent, or Firm*—Steven L. Christian

(57) ABSTRACT

A system is disclosed for generating and transmitting data signals to the surface of the earth while drilling a borehole, the system operating by generating pressure pulses in the drilling fluid filling the drill string. The system is designed to maximize signal strength while minimizing the probability of jamming by drilling fluid particulates. The system uses a rotary valve modulator consisting of a stator with flow orifices through which drilling fluid flows, and a rotor which rotates with respect to the stator thereby opening and restricting flow through the orifices and thereby generating pressure pulses. The flow orifices with the stator in a "closed" position are configured to reduce jamming, and to simultaneously minimize flow area in order to maximize signal strength. This is accomplished by imparting a shear to the fluid flow through the modulator, and minimizing the aspect ratio and maximizing the minimum principal dimension of the closed flow area. A preferred embodiment and three alternate embodiments of the modulator are disclosed.

14 Claims, 5 Drawing Sheets

PRESSURE PULSE GENERATOR FOR MEASUREMENT-WHILE-DRILLING SYSTEMS WHICH PRODUCES HIGH SIGNAL STRENGTH AND EXHIBITS HIGH RESISTANCE TO JAMMING

CROSS-REFERENCE TO RELATED APPLICATION

This application claims priority from U.S. Provisional Application No. 60/066,643, filed Nov. 18, 1997, the contents of which are incorporated herein by reference.

BACKGROUND OF THE INVENTION

1. Field of the Invention

This invention relates to communication systems, and particularly to systems and methods for generating and transmitting data signals to the surface of the earth while drilling a borehole, wherein the transmitted signal is maximized and the probability of the system being jammed by drilling fluid particulates is minimized.

2. Description of the Related Art

It is desirable to measure or "log", as a function of depth, various properties of earth formations penetrated by a borehole while the borehole is being drilled, rather than after completion of the drilling operation. It is also desirable to measure various drilling and borehole parameters while the borehole is being drilled. These technologies are known as logging-while-drilling and measurement-while-drilling, respectively, and will hereafter be referred to collectively as "MWD". Measurements are generally taken with a variety of sensors mounted within a drill collar above, but preferably close, to a drill bit which terminates a drill string. Sensor responses, which are indicative of the formation properties of interest or borehole conditions or drilling parameters, are then transmitted to the surface of the earth for recording and analysis.

Various systems have been used in the prior art to transmit sensor response data from downhole drill string instrumentation to the surface while drilling a borehole. These systems include the use of electrical conductors extending through the drill string, and acoustic signals that are transmitted through the drill string. The former technique requires expensive and often unreliable electrical connections that must be made at every pipe joint connection in the drill string. The latter technique is rendered ineffective under most conditions by "noise" generated by the actual drilling operation.

The most common technique used for transmitting MWD data utilizes drilling fluid as a transmission medium for acoustic waves modulated downhole to represent sensor response data. The modulated acoustic waves are subsequently sensed and decoded at the surface of the earth. The drilling fluid or "mud" is typically pumped downward through the drill string, exits at the drill bit, and returns to the surface through the drill string-borehole annulus. The drilling fluid cools and lubricates the drill bit, provides a medium for removing drill bit cuttings to the surface, and provides a hydrostatic pressure head to balance fluid pressures within formations penetrated by the drill bit.

Drilling fluid data transmission systems are typically classified as one of two species depending upon the type of pressure pulse generator used, although "hybrid" systems have been disclosed. The first species uses a valving system to generate a series of either positive or negative, and essentially discrete, pressure pulses which are digital representations of transmitted data. The second species, an example of which is disclosed in U.S. Pat. No. 3,309,656, comprises a rotary valve or "mud siren" pressure pulse generator which repeatedly interrupts the flow of the drilling fluid, and thus causes varying pressure waves to be generated in the drilling fluid at a carrier frequency that is proportional to the rate of interruption. Downhole sensor response data is transmitted to the surface of the earth by modulating the acoustic carrier frequency.

U.S. Pat. No. 5,182,730 discloses a first species of data transmission system which uses the bits of a digital signal from a downhole sensor to control the opening and closing of a restrictive valve in the path of the mud flow. Such a transmission may reduce interference from drilling fluid circulation pump or pumps, and interference from other drilling related noises. The data transmission rate of such a system is, however, relatively slow as is well known in the art.

U.S. Pat. No. 4,847,815, which is incorporated herein by reference, discloses an additional example of the second species of data transmission system comprising a downhole rotary valve or mud siren. The data transmission rate of this system is relatively high, but it is susceptible to extraneous noise such as noise from the drilling fluid circulation pump. Additionally, for low flows, deep wells, small diameter drill strings, and/or high viscosity muds, this system requires small gap settings for maximizing signal pressure at the modulator. Under these conditions the system is susceptible to plugging or "jamming" by solid particulate material in the drilling mud, such as lost circulation material "LCM", which will be subsequently defined.

U.S. Pat. No. 5,375,098, also incorporated herein by reference, discloses an improved rotary valve system which includes apparatus and methods for suppressing noise. Although data transmission rates are relatively high and relatively free of noise distortion, this rotary valve system is still susceptible to jamming by solid particulates at small gap settings.

The effects of the above parameters are shown by the signal strength relationship from Lamb, H., *Hydrodynamics,* Dover, New York, N.Y. (1945), pages 652–653, which is:

$$S=S_o \exp[-4\pi F(D/d)^2(\mu/\mathrm{K})]$$

where

S=signal strength at a surface transducer;

$S_o$=signal strength at the downhole modulator;

F=carrier frequency of the MWD signal expressed in Hertz;

D=measured depth between the surface transducer and the downhole modulator;

d=inside diameter of the drill pipe (same units as measured depth);

$\mu$=plastic viscosity of the drilling fluid; and

K=bulk modulus of the volume of mud above the modulator, and by the modulator signal pressure relationship $$S_o\ (\rho_{mud} \times Q^2)/A^2$$

where $S_o$=signal strength at the downhole modulator;

$\rho_{mud}$=density of the drilling fluid;

Q=volume flow rate of the drilling fluid; and

A=the flow area with the modulator in the "closed" position, a function of the gap setting.

U.S. Pat. No. 5,583,827 discloses a rotary valve telemetry system which generates a carrier signal of constant frequency, and sensor data are transmitted to the surface by modulating the amplitude rather than the frequency of the carrier signal. Amplitude modulation is accomplished by varying the spacing or "gap" between a rotor and stator component of the valve. Gap variation is accomplished by a system which induces relative axial movement between rotor and stator depending upon the digitized output of a downhole sensor. The '827 patent also discloses the use of a plurality of such valve systems operated in tandem. The system is, however, mechanically and operationally complex, and is also subject to the same jamming limitations as previously discussed when operating at the small gap positions necessary for generating maximum signal amplitude.

All drill string components, including MWD tools, should be designed to allow the continuous flow of solids and additives suspended in the drilling fluid. As discussed previously, an important example of an additive is lost circulation material or "LCM". One type of common LCM is "medium nut plug" which is a material used to control lost circulation of drilling fluids into certain types of formations penetrated by the drill bit during the drilling operation. This material can be of vital importance in drilling a well when it is used to plug fractures in formations, to isolate incompetent formations to which drilling fluid can be lost, or when drilling parameters result in too much overbalance pressure in the wellbore annulus with respect to the formation pressure. If loss of the drilling fluid occurs, the hydrostatic balance of the well may be disrupted and containment of the subsurface formation pressure may be lost. This has extreme negative safety implications for a rig and crew since loss of well control can lead to a "kick" and possibly a "blow-out" of the well. In view of these drilling mechanics and safety aspects, LCM such as medium nut plug is required in some drilling operations. Drilling equipment, including MWD equipment, must be able to pass LCM. As a result, the passage of medium nut plug is also a commonly accepted standard by which particulate performance of MWD tools is measured.

If jamming and plugging of the drill string occurs during flow of LCM in controlling lost circulation, the drill string must be removed from the well. This is a costly and complex operation, especially if the well and the downhole pressures are not stable. It is vital, therefore, to maintain the ability to transport LCM downhole via the drill string to arrest lost circulation problems in the well. LCM must, therefore, pass through all elements of the drill string, including the pressure pulse generator of a MWD tool.

Prior art rotary valve type pressure pulse modulators have used a lateral gap between the stator and rotor of the modulator to provide a flow area for drilling fluid, even when the modulator is in the "closed" position. As a result, the modulator is never completely closed as the drilling fluid must maintain a continuous flow for satisfactory drilling operations to be conducted. Thus, drilling fluid and particulate additives or debris must pass through the lateral gap of the modulator when it is in the closed position. In the prior art designs, the lateral gap has been limited to certain minimum values. At lateral gap settings below the minimum value, performance of the data telemetry system is degraded with respect to LCM tolerance such that jamming or plugging of the drill string may occur. Conversely, it is required that the lateral gap and associated closed flow area be as small as practical in order to maximize telemetry signal strength, which is proportional to the difference in differential pressure across the modulator when the modulator in the fully "open" and fully "closed" positions. Signal strength must be maximized at the MWD tool in order to maintain signal strength at the surface when low drilling fluid flow rates, increased well depths, smaller drill string cross sections, and/or high mud viscosity are mandated by the geological objective and particular drilling environment encountered. If the gap is reduced to less than the size of any particulate additives, there is increased difficulty in transporting these additives or debris through the modulator. At a certain point, depending upon the setting of the lateral gap between the rotor and the stator, the particle size and concentration, particle accumulation, packing and plugging of the drill string can occur. Additionally, at lower modulator frequencies, the amount of accumulation will be greater since the modulator is in the "closed" position for a longer period of time. Differential pressure will force the particles into the gap where they may wedge and jam the modulator. When this happens, the modulator rotor may malfunction, jam in the closed position, and the drill string may be packed off and plugged upstream from the modulator.

SUMMARY OF THE INVENTION

In view of the foregoing discussion of prior art, an object of this invention is to provide a pressure pulse generator, otherwise known as a modulator, with a high signal strength while allowing the free passage of drilling fluid particulates, such as LCM or debris, and thereby resisting jamming or plugging.

Another object of the invention is to provide a pressure pulse modulator which exhibits jamming or plugging resistance under a wide range of drilling fluid flow conditions, tubular geometries, well depths, and drilling fluid theological properties.

Yet another object of the invention is to provide a pressure pulse modulator which provides high signal strength with jam free operation under a wide range of drilling fluid flow conditions, tubular geometries, well depths, and drilling fluid theological properties.

Another objective of the invention is to provide a pressure pulse modulator which meets the above stated signal strength and operational characteristics, and still produces a suitable data transmission rate.

Still another objective of the invention is to provide a pressure pulse modulator which meets the above stated signal strength, data transmission rate and operational characteristics with an efficient use of available downhole power to operate the modulator.

Additional objects, advantages and applications of the invention will become apparent to those skilled in the art in the following detailed description of the invention and appended figures.

In accordance with the objects of the invention, a MWD modulator is provided and generally comprises a stator, a rotor which rotates with respect to the stator, and a "closed" flow opening area which is configured to reduce jamming, and which is reduced in area to maintain a desired signal strength. It has been found that the closed flow area "A" determines, for given drilling and borehole conditions, the signal strength, but the aspect ratio of the closed flow area A determines the opening's tendency to jam with particulates transported within the drilling fluid. The aspect ratio of the closed flow area A is defined as the ratio of the maximum dimension of the opening divided by the minimum dimension of the opening. As an example, assume that one closed flow passage of area A has a high aspect ratio due to a relatively large maximum dimension (such as a long rotor blade) and a relatively small minimum dimension (such as a narrow rotor-stator gap). Assume that a second closed flow passage of the same area A has a lower aspect ratio, which would be a passage in the form of a circle, a square, or some other shape. The signal pressure amplitude would be the same for both, since the areas A are equal. The closed flow opening with the smaller aspect ratio will exhibit less of a tendency to trap particulates, assuming that the minimum principal dimension is greater than the particle size. For the opening with the long and narrow area, the narrow or minimum principal dimension (i.e. the gap setting) is sometimes required to be less than the size of particular additives, such as medium nut plug LCM, in order to obtain usable telemetry signal strength under certain conditions of flow rate, well depth, telemetry frequency, drilling fluid weight, drilling fluid viscosity and drill string size. This can result in jamming of the modulator and subsequent plugging of the drill string.

The rotor and stator of the present modulator are configured so that the area A of the fluid flow path with the modulator in the "closed" position is sufficiently small to obtain the desired signal strength, but also configured with a low aspect ratio and sufficient minimum principal dimension to prevent particulate accumulation, jamming, and plugging. Several shapes including circular, triangular, rectangular, and annular sector openings are disclosed. Because of the improved closed flow path geometry, the gap between the modulator rotor and stator can be reduced to sufficiently tight clearances to further increase signal strength and also to exclude particulates such that jamming between rotor blades and stator lobes does not occur. The particles are instead swept or scraped by interaction of the rotor blades with the stator lobes during rotation into the "open" position of the modulator orifices and are carried away by the drilling fluid. When the rotor blade lateral faces bring particles against stator lateral faces, shearing of particles by the rotor can occur. This shearing is assisted by a magnetic positioner torque which is part of the system described in U.S. Pat. No. 5,237,540, which is incorporated herein by reference. The power required to operate the modulator in this configuration under high concentrations of particulate additives is significantly reduced as compared to prior art modulators. The rotor/stator arrangement of the present invention is somewhat analogous to a set of sharp, tight fitting scissors, while prior art modulators with large rotor/stator gaps are likewise analogous to dull, loose fitting scissors. The former cuts and shears with minimum effort, while the latter cuts poorly and jams.

BRIEF DESCRIPTION OF THE DRAWINGS

So that the manner in which the above recited features, advantages and objects of the present invention are attained can be understood in detail, more particular description of the invention, briefly summarized above, may be had by reference to the embodiments thereof which are illustrated in the appended drawings.

It is to be noted, however, that the appended drawings illustrate only typical embodiments of the invention and are therefore not to be considered limiting of its scope, for the invention may admit to other equally effective embodiments.

DESCRIPTION OF THE PREFERRED EMBODIMENTS

Figure 1:
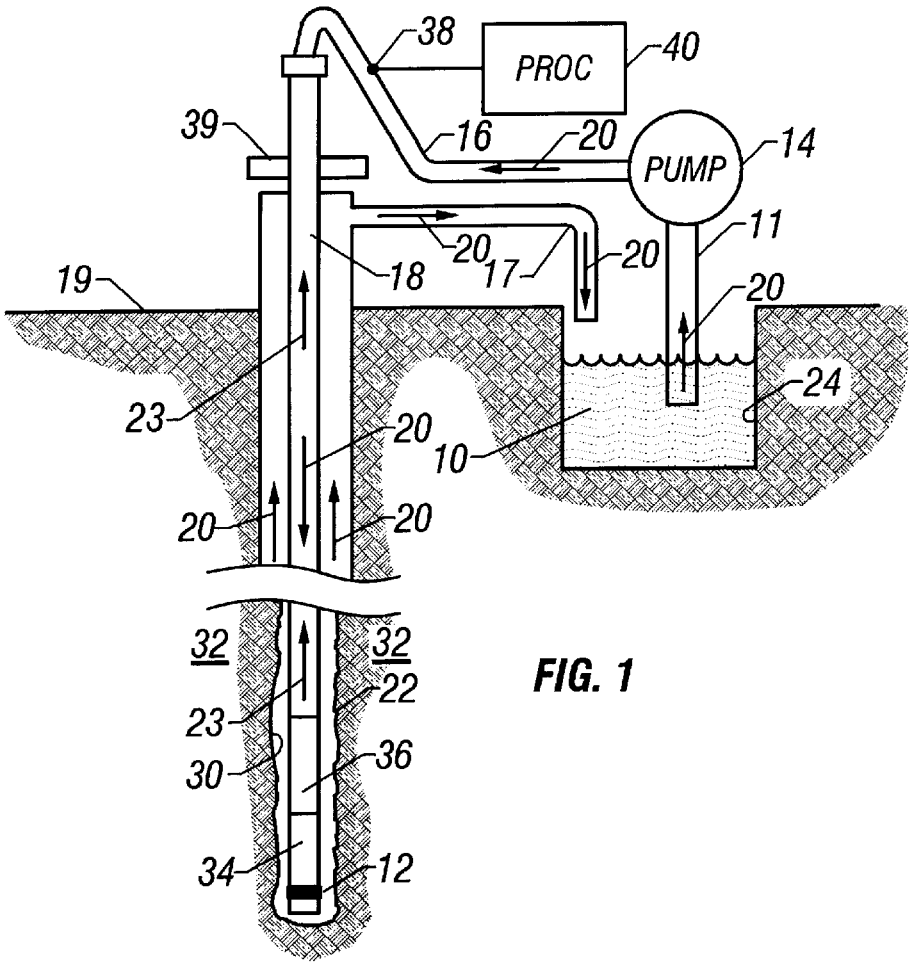
FIG. 1 illustrates the present invention embodied in a typical drilling apparatus.

FIG. 1 illustrates the present invention incorporated into a typical drilling operation. A drill string 18 is suspended at an upper end by a kelly 39 and conventional draw works (not shown), and terminated at a lower end by a drill bit 12. The drill string 18 and drill bit 12 are rotated by suitable motor means (not shown) thereby drilling a borehole 30 into earth formation 32. Drilling fluid or drilling "mud" 10 is drawn from a storage container or "mud pit" 24 through a line 11 by the action of one or more mud pumps 14. The drilling fluid 10 is pumped into the upper end of the hollow drill string 18 through a connecting mud line 16. Drilling fluid flows under pressure from the pump 14 downward through the drill string 18, exits the drill string 18 through openings in the drill bit 12, and returns to the surface of the earth by way of the annulus 22 formed by the wall of the borehole 30 and the outer diameter of the drill string 18. Once at the surface, the drilling fluid 10 returns to the mud pit 24 through a return flow line 17. Drill bit cuttings are typically removed from the returned drilling fluid by means of a "shale shaker" (not shown) in the return flow line 17. The flow path of the drilling fluid 10 is illustrated by arrows 20.

Still referring to FIG. 1, a MWD subsection 34 consisting of measurement sensors and associated control instrumentation is mounted preferably in a drill collar near the drill bit 12. The sensors respond to properties of the earth formation 32 penetrated by the drill bit 12, such as formation density, porosity and resistivity. In addition, the sensors can respond to drilling and borehole parameters such as borehole temperature and pressure, bit direction and the like. It should be understood that the subsection 34 provides a conduit through which the drilling fluid 10 can readily flow. A pulse signal device or modulator 36 is positioned preferably in close proximity to the MWD sensor subsection 34. The pulse signal device 36 converts the response of sensors in the subsection 34 into corresponding pressure pulses within the drilling fluid column inside the drill string 18. These pressure pulses are sensed by a pressure transducer 38 at the surface 19 of the earth. The response of the pressure transducer 38 is transformed by a processor 40 into the desired response of the one or more downhole sensors within the MWD sensor subsection 34. The direction of propagation of pressure pulses is illustrated conceptually by arrows 23. Downhole sensor responses are, therefore, telemetered to the surface of the earth for decoding, recording and interpretation by means of pressure pulses induced within the drilling fluid column inside the drill string 18.

As described previously, pulse signal devices are typically classified as one of two species depending upon the type of pressure pulse generator used. The first species uses a valving system to generate a series of either positive or negative, and essentially discrete, pressure pulses which are digital representations of the transmitted data. The second species comprises a rotary valve or "mud siren" pressure pulse generator, which repeatedly restricts the flow of the drilling fluid, and causes varying pressure waves to be generated in the drilling fluid at a frequency that is proportional to the rate of interruption. Downhole sensor response data is transmitted to the surface of the earth by modulating the acoustic carrier frequency. The pulse signal device 36 of the present invention is of the second species.

Figure 2A:
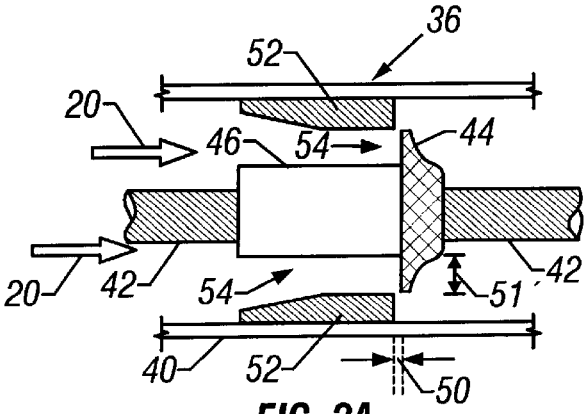
FIG. 2A (Prior Art)
FIG. 2*a* is an axial sectional view of a pressure modulation device comprising a stator and rotor.

FIG. 2*a* is an axial sectional view of the major components of a rotary valve or mud siren type pulse signal device. The pulse signal device 36 comprises a bladed rotor 44 which turns on a shaft 42 and bearing assembly 46. Drilling fluid, again indicated by the flow arrows 20, enters a stator comprising a stator body 52 and preferably a plurality of stator orifices 54. The drilling fluid flow through the stator-rotor assembly of the pulse signal device 36 is restricted by the rotation of the rotor as is better seen in FIGS. 2*b* and 2*c*.

Figure 2B:
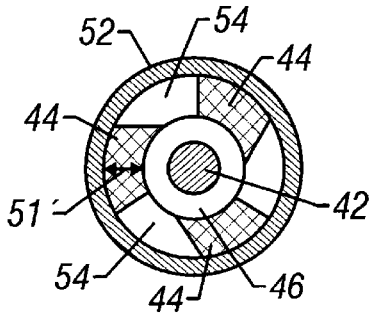
FIG. 2B (Prior Art)
FIG. 2*b* is a view of a prior art stator and rotor assembly in a fully open position.
Figure 2C:
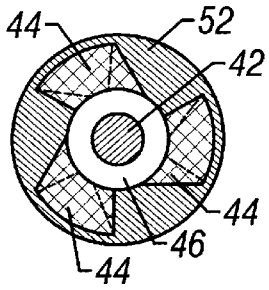
FIG. 2C (Prior Art)
FIG. 2*c* is a view of the prior art stator and rotor assembly in a fully closed position.

FIG. 2*b* is a view of the rotor 44 and stator orifices 54 and stator body 52 as seen in a plane perpendicular to the shaft 42. FIG. 2*b* depicts a prior art stator-rotor assembly, where the relative positions of the rotor blades and stator orifices are such that the restriction of drilling fluid flow through the assembly is at a minimum. This is referred to as the "open" position. FIG. 2*c* shows the same perspective view of the prior art stator-rotor assembly as FIG. 2*b,* but with the relative positions of the rotor blades and the stator orifices such that the restriction of the drilling fluid flow through the assembly is at a maximum. This is referred to as the "closed" position.

Figure 3:
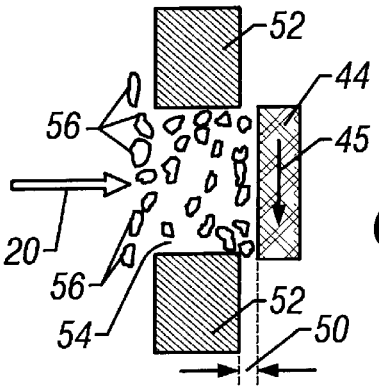
FIG. 3 (Prior Art)
FIG. 3 is a lateral sectional view of the prior art rotor blade and stator body and flow orifice.

Drilling fluid flow through the stator-rotor assembly is not terminated when the assembly is in the closed position. This is because of a finite separation or "gap" 50 between the rotor and stator, as best seen in FIG. 2*a*. As a result, the pulse signal device 36 is never completely closed since the drilling fluid 10 must maintain a continuous flow for satisfactory drilling operations to be conducted. Thus, drilling fluid 10 and any particulate additives or debris suspended within the drilling fluid must pass through the gap 50 when the pulse signal device 36 is in the closed position. In the prior art, the gap 50 has been limited to certain minimum values. At gap settings below these minimum values, the pulse signal device 36 tends to jam or plug with particles 56 in the drilling fluid as illustrated in FIG. 3 More specifically, when the rotor blade 44 aligns with the stator orifice 54 as shown in FIG. 3, the particles 56 tend to jam in the gap 50. Arrow 45 illustrates the direction of rotor blade movement with respect to the stator. Jamming at the stator-rotor assembly of the pulse signal device 36 can cause plugging of the entire drill string 18. From a jamming and plugging perspective, it is therefore desirable to make the gap 50 as large as possible. From a telemetry signal strength aspect, it is desirable to set the gap 50 as small as possible so that the associated flow area is minimized when the pulse signal device 36 is in the closed position. Minimum "closed" flow area maximizes the telemetry signal strength, which is proportional to the pressure differential between the modulator in the fully "open" and fully "closed" positions. Signal strength must be maximized at the MWD subsection 34 in order to maintain signal strength at the pressure transducer 38 at the surface when low drilling fluid flow rates, increased well depths, small drill string cross sections, and/or high mud viscosity are mandated by the geological objective and the particular drilling environment encountered. Stated mathematically, $$S_o\,(\rho_{mud}\times Q^2)/A^2$$

where $S_o$=signal strength at the downhole modulator;

ρmud=density of the drilling fluid;

Q=volume flow rate of the drilling fluid; and

A=the flow area with the modulator in the "closed" position, a function of the gap setting.

The signal strength at the surface, S, using the previously referenced work of Lamb, is expressed as $$S=S_o\,\exp[-4\pi F(D/d)^2(\mu/K)]$$

where

S=signal strength at a surface transducer;

$S_o$=signal strength at the downhole modulator;

F=carrier frequency of the MWD signal expressed in Hertz;

D=measured depth between the surface transducer and the downhole modulator;

d=inside diameter of the drill pipe (same units as measured depth);

$\mu$=plastic viscosity of the drilling fluid; and

K=bulk modulus of the volume of mud above the modulator. If the gap 50 is reduced to less than the size of the particulate additive particles 56, there is increased difficulty in transporting these additives or debris through the modulator. At a certain point, depending upon the setting of the gap 50 between the rotor blades 44 and the stator body 52, the particle size, and the particle concentration, packing and plugging of the drill string 18 can occur. Additionally, at lower modulator frequencies, the amount of accumulation will be greater since the modulator is in the "closed" position for a longer period of time. Differential pressure will force the particles 56 into the gap 50 where they may wedge and jam the modulator, especially in the case of LCM which, by design, is intended to seal and create a pressure barrier. When this happens, the modulator rotor 44 may malfunction and jam in the closed position, and the drill string 18 may be packed off and plugged upstream from the pulse signal device 36.

It has been found that the closed flow area A determines, for given conditions, the signal strength, but the aspect ratio and the minimum principal dimension of the closed flow area A determines the opening's tendency to jam with particulates transported within the drilling fluid. The aspect ratio of the closed flow area A is defined as the ratio of the maximum dimension of the opening divided by the minimum dimension of the opening. As an example, assume that one closed flow passage of area A has a high aspect ratio due to a relatively large maximum dimension such as the blades of the rotor 44 with a relatively long radial extent 51' (see FIG. 2*b*), and a relatively small minimum dimension such as a narrow gap 50. This is typical of the prior art devices illustrated in FIGS. 2*b*, 2*c* and 3. These prior art devices tend to jam as illustrated in FIG. 3.

The present invention employs a labyrinth "seal" between the rotor and the stator which defines a much smaller lateral gap between these two components. In addition, the present invention also employs a closed flow passage with typically the same closed flow area A as prior art devices, but with a closed flow area that has a smaller aspect ratio and a minimum principal dimension greater than the anticipated maximum particle size. The invention retains signal strength, yet resists jamming with particulate matter.

A preferred and three alternate embodiments of the invention are disclosed, with the alternate embodiments being presented first. It should be emphasized that the alternate embodiments of the invention, as well as the preferred embodiment, employ apparatus and methods to obtain closed flow openings with low aspect ratios and minimum principal dimensions to prevent signal device jamming, and with closed flow areas sufficiently small to obtain the desired signal telemetry strength.

Alternate Embodiments

Figure 4A:
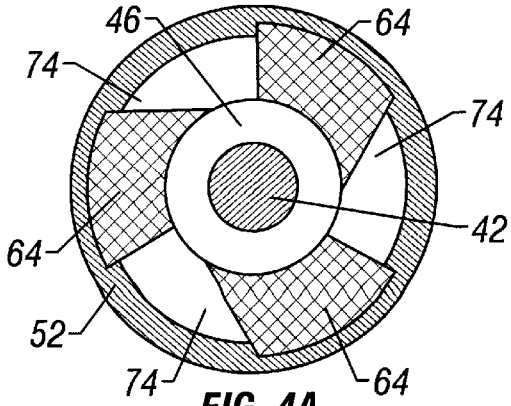
FIG. 4*a* is a view of a first alternate embodiment of a stator and rotor assembly of the present invention in a fully open position.
Figure 4B:
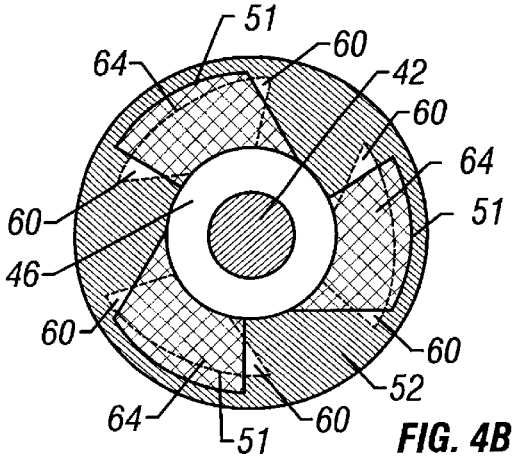
FIG. 4*b* is a view of the first alternate embodiment of the stator and rotor assembly of the present invention in a fully closed position.
Figure 4C:
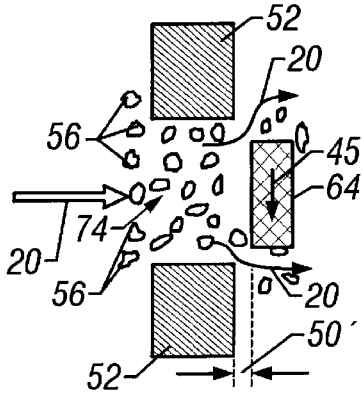
FIG. 4*c* is a lateral sectional view of the rotor blade and stator body and flow orifice of the present invention in the first alternate embodiment.
Figure 4D:
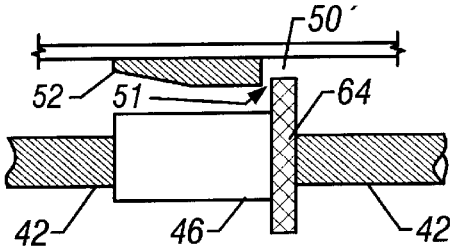
FIG. 4*d* is a sectional view of a labyrinth seal between the stator and a rotor blade.

FIG. 4*a* is a view of a rotor 64 and stator assembly of a first alternate embodiment of the invention, as seen perpendicular to the shaft 42, in the open position. FIG. 4*b* depicts the same perspective view of the rotor-stator assembly of the first alternate embodiment in the closed position. Rotor blades 64 and the stator orifices 74 are configured such that the closed flow areas, identified by the numeral 60, form approximately equilateral triangles with small aspect ratios. As shown in FIG. 4*d*, the rotor blades 64 overlap the stator body 52 to form a labyrinth seal identified by the numeral 51 and defining an axial gap 50'. The low aspect ratio of the cumulative closed flow area with a minimum principal dimension greater than the anticipated maximum particle size prevents jamming. This is seen in the axial view of FIG. 4*c*, wherein the axial gap 50' defined by the labyrinth seal 51 is substantially reduced, while the rotor blade and stator orifice design allows drilling fluid and suspended particles 56 to flow through the closed flow area as illustrated by the arrows 20. Even with this enhanced jamming performance, the cumulative magnitude A of the closed flow path remains relatively small, thereby maintaining the desired signal strength. Once again, the arrow 45 illustrates the direction of rotor blade movement with respect to the stator in the first alternate embodiment of the invention.

Figure 5A:
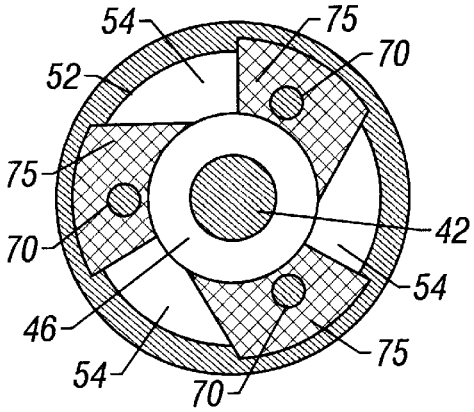
FIG. 5*a* is a view of a second alternate embodiment of a stator and rotor assembly of the present invention in a fully open position, wherein each rotor blade comprises a flow opening.
Figure 5B:
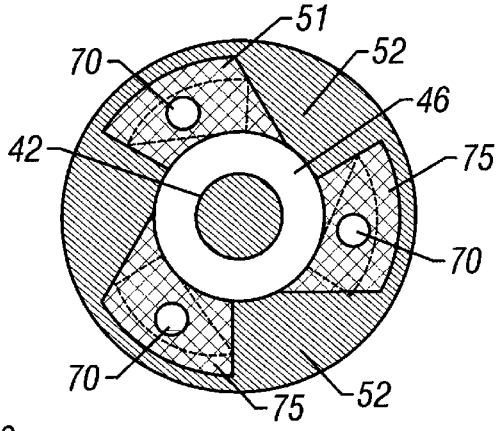
FIG. 5*b* is a view of the second alternate embodiment of the stator and rotor assembly of the present invention in a fully closed position.
Figure 5C:
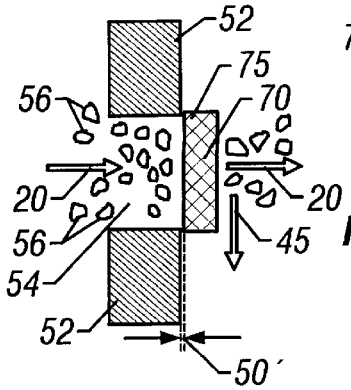
FIG. 5*c* is a lateral sectional view of a rotor blade and stator body and flow orifice of the present invention in the second alternate embodiment.

FIG. 5*a* is a view of a rotor 75 and stator assembly of a second alternate embodiment of the invention, as seen perpendicular to the shaft 42, in the open position. The stator orifices 54 and body 52 are, for purposes of discussion, the same as those illustrated in FIGS. 2*b,* 2*c,* and 3. The rotor blades 75 contain preferably circular flow passages 70 which have an aspect ratio of 1.0 and principal dimension (diameter) greater than the maximum anticipated particle size. FIG. 5*b* illustrates the second alternate stator-rotor assembly in the closed position. The rotor blades 75 and the stator orifices 54 are aligned such that drilling fluid and suspended particles 56 can pass through the circular flow passages 70 with reduced probability of jamming since the aspect ratio of each opening is low with sufficient minimum principal dimension (diameter) to allow passage of particulate matter. Again, for purposes of discussion, assume that the sum of the areas of the flow passages 70 is equal to A. Also, the labyrinth seal 51 as described above is again present. The second alternate embodiment is shown in the axial view of FIG. 5*c,* wherein the gap 50' again is substantially reduced to only allow movement between the rotor and stator, while the rotor blade and stator orifice design allows drilling fluid 10 containing suspended particles 56 to flow through the closed flow path as illustrated by the arrows 20. Even with the enhanced jamming performance due to the closed flow area with a small aspect ratio and sufficient minimum principal dimension to allow passage of particulate matter, the magnitude of the flow area remains relatively small, thereby maintaining the desired signal strength. Again, the arrow 45 illustrates the direction of rotor blade movement with respect to the stator.

Figure 6A:
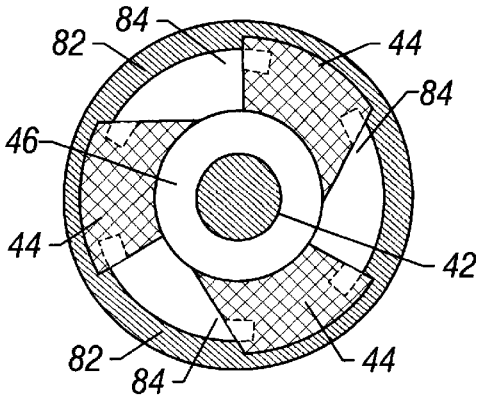
FIG. 6*a* is a view of a third alternate embodiment of a stator and rotor assembly of the present invention in a fully open position, wherein each stator flow orifice comprises flow indentations.
Figure 6B:
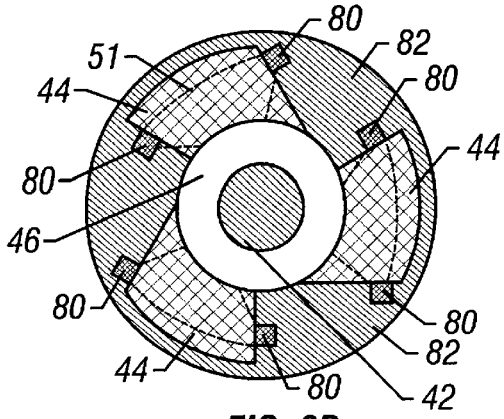
FIG. 6*b* is a view of the third alternate embodiment of the stator and rotor assembly of the present invention in a fully closed position.
Figure 6C:
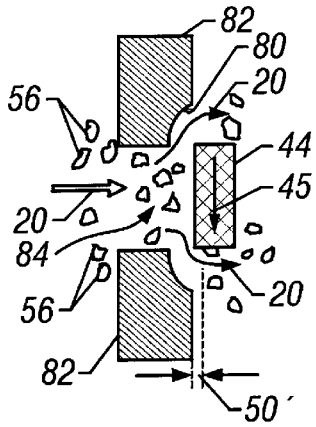
FIG. 6*c* is a lateral sectional view of a rotor blade and stator body and flow orifice of the present invention in the third alternate embodiment.

FIGS. 6*a*–6*c* illustrate yet a third alternate embodiment of the invention. FIG. 6*a* is a view of a rotor and stator assembly, as seen perpendicular to the shaft 42, in the open position. The rotor 44 is, for purposes of discussion, identical to the rotor design shown in FIGS. 2*b* and 2*c*. The stator body 82, however, contains recesses 80 on each side of the stator orifices 84 as shown in FIG. 6*b,* which also illustrates the stator-rotor assembly in the closed position. Again, the previously described labyrinth seal 51 is present. The rotor blades 44 and the stator orifices 84 are aligned in the closed position so that drilling fluid and suspended particles 56 can pass through the recesses 80 as shown in FIG. 6*c*. The flow area in this closed position is configured approximately as a square thereby minimizing the aspect ratio. The gap 50' is again set to a minimum value which permits free movement between the rotor and stator. Again, the arrow 45 illustrates the direction of rotor blade movement with respect to the stator. Particle jamming is again prevented with this third alternate embodiment of the invention since the aspect ratio of the closed flow path through the recesses 80 is small with sufficient minimum principal dimension to allow passage of particulate matter. It is again assumed for purposes of discussion that the sum of the areas of the flow passages through the recesses 80 is equal to A. This third alternate embodiment of the invention also allows drilling fluid 10 containing suspended particles 56 to flow through the closed flow area A as illustrated by the arrows 20 with reduced likelihood of jamming. The magnitude A of the area once again remains relatively small thereby maintaining the desired signal strength.

Preferred Embodiment

Figure 8A:
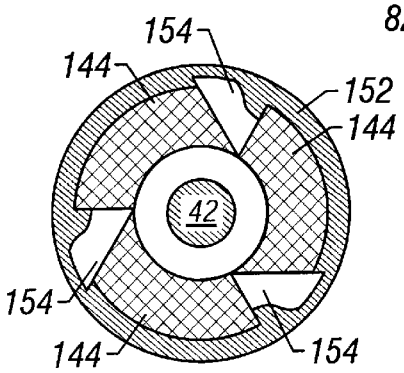
FIG. 8*a* illustrates a preferred embodiment of the stator and rotor assembly of the present invention in a fully open position.
Figure 8B:
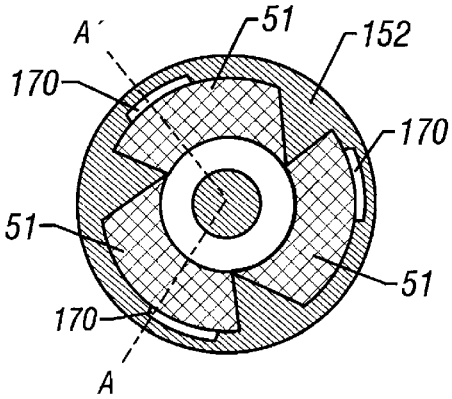
FIG. 8*b* illustrates the preferred embodiment of the invention with the stator and rotor assembly in a fully closed position.
Figure 8C:
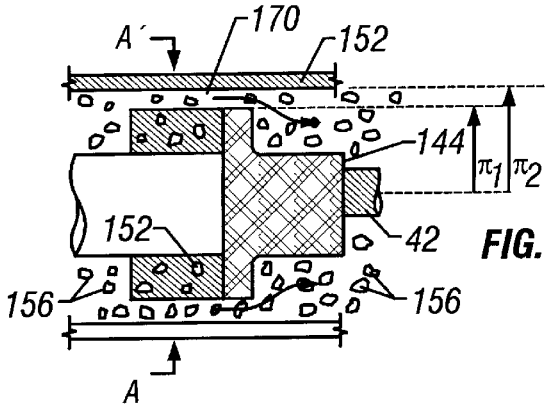
FIG. 8*c* is a lateral sectional view of the rotor and stator assembly of the preferred embodiment of the invention in the fully closed position.

FIGS. 8*a*–8*c* illustrate the preferred embodiment of the invention. Similar operational principles as previously detailed also apply to this preferred embodiment. FIG. 8*a* is a view of a rotor 144 and stator assembly, as seen perpendicular to the shaft 42. The radius of each blade of the rotor 144 is defined as $r_1$ and is measured from the center line axis of the shaft 42 to the outer perimeter of the rotor. The position of the rotor 144 with respect to stator orifices 154 within the body 152 is such that the orifices are completely open. The radius of each stator orifice 154 is defined as $r_2$ and is measured from the center line axis of the shaft 42 to the outer perimeter of the orifice. FIG. 8*b* illustrates the rotor-stator assembly in the fully closed position, leaving closed flow orifices 170 through which drilling fluid and suspended particles can flow. Labyrinth seals 51 are again employed between the rotor 144 and the stator body 152. The closed flow orifice, or minimum principal dimension, is therefore defined by the difference in radii $r_1$ and $r_2$. FIG. 8*c* is a lateral sectional view A–A' of FIG. 8*b,* and more clearly shows the movement of suspended particles 156 through the closed flow orifices 170. In this preferred embodiment, the area of the closed flow orifices 170 remains constant for a certain period of time to extend the duration of the pressure pulse to impart more energy to the pressure signal. This additional energy further helps in the transmission of the pressure signal to the surface. Additionally, the pulse shape more closely approximates a sinusoid, the advantages of which have been detailed in U.S. Pat. No. 4,847,815. In the '815 patent, the modulator signal starts to deviate from the sinusoid as the lateral gap between rotor and stator is reduced for higher signal amplitudes.

Figure 9A:
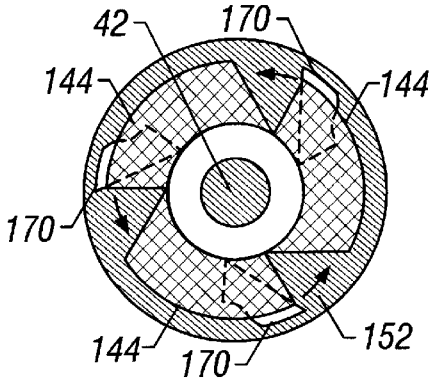
FIG. 9*a* is a view of the stator and rotor assembly of the preferred embodiment of the invention at the beginning of a time period in which the assembly is in the fully closed position.
Figure 9B:
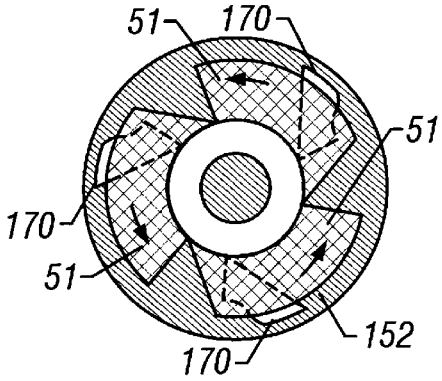
FIG. 9*b* is a view of the stator and rotor assembly of the preferred embodiment of the invention at the end of the time period in which the assembly is in the fully closed position.
Figure 9C:
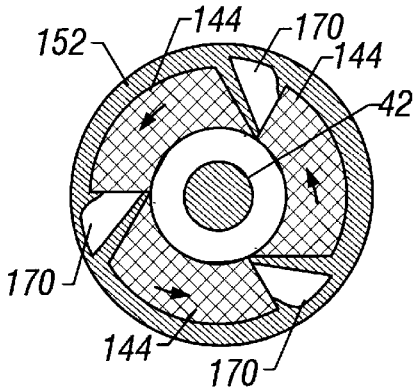
FIG. 9*c* is a view of the stator and rotor assembly of the preferred embodiment of the invention in transition between the fully open position and the fully closed position.

Features of the preferred embodiment of the invention are further illustrated in FIGS. 9*a,* 9*b,* and 9*c*. FIG. 9*a* shows the position of the rotor 144 at the start of the closed position, and FIG. 9*b* shows the position of the rotor 144 at a later time at the end of the closed position. It is apparent that the areas of the closed flow orifices 170 remain constant during the period of time extending from the start of the closed position (FIG. 9*a*) to the end of the closed position (FIG. 9*b*). FIG. 9*c* is a view of the rotor and stator assembly of the preferred embodiment of the invention in transition between the fully open position (FIG. 8*a*) and the fully closed position (FIGS. 9*a* and 9*b*). In the preferred embodiment, the pulse shape and duration is controlled by the amount of angular rotation of the rotor 144 where the area of the closed flow orifices 170 remains constant or, alternately stated, "dwells" in the closed position. This results in a pulse shape, as will be discussed in a subsequent section, which is substantially different from the pulse shapes produced by other embodiments of the invention. Otherwise, the aspect ratio of the closed flow area along with the minimum principal dimension allows passage of normal mud particles 156 and additives such as medium nutplug LCM as described in other embodiments of the invention. Other features described in other embodiments are also applicable to the preferred embodiment.

Performance

As previously discussed, the present pulsed signal device repeatedly restricts the drilling fluid flow causing a varying pressure wave to be generated in the drilling fluid with a frequency proportional to the rate of restriction. Downhole sensor data are then transmitted through the drilling fluid within the drill string by modulating this acoustic character.

Figure 7:
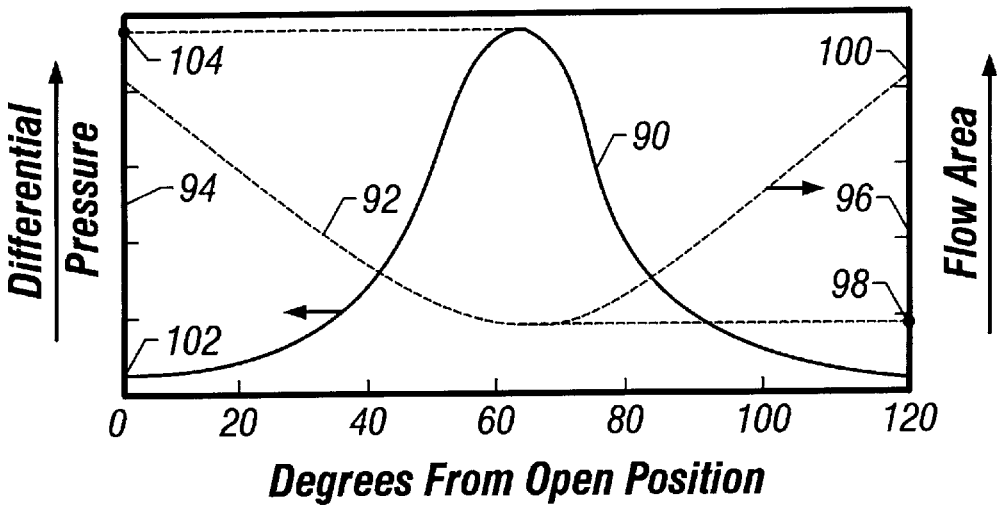
FIG. 7 shows the relationships between rotor position, differential pressure across the modulator device, and fluid flow area for the embodiments of the invention illustrated in the first, second and third alternate embodiments of the invention.

FIG. 7 shows the relationship 90 between modulator rotor position and differential pressure across the modulator and the relationship 92 between rotor position and flow area for all embodiments of the invention except the preferred embodiment. The rotor-stator assembly comprises three rotor blades spaced on 120 degree centers and three stator orifices also spaced on 120 degree centers. The number of degrees of the rotor from the fully "open" position is plotted on the abscissa. The curve 90 represents differential pressure across the modulator on the left hand ordinate scale 94. The curve 92 represents fluid flow area through the modulator on the right hand ordinate scale 96. Since there are three rotor blades, the pressure modulator assembly will be fully "closed" at a value of 60 degrees from the fully "open" position. This is reflected in the peak 104 in the differential pressure curve 90 and the minimum 98 in the flow area curve 92 at 60 degrees from the open position. Conversely, at 0 degrees and 120 degrees from the open position, the differential pressure curve 90 exhibits minima 102 and the flow area curve 92 exhibits maxima 100. The curve 90 representing differential pressure varies inversely with flow area squared as would be expected from the modulator signal pressure relationship previously discussed.

Figure 10:
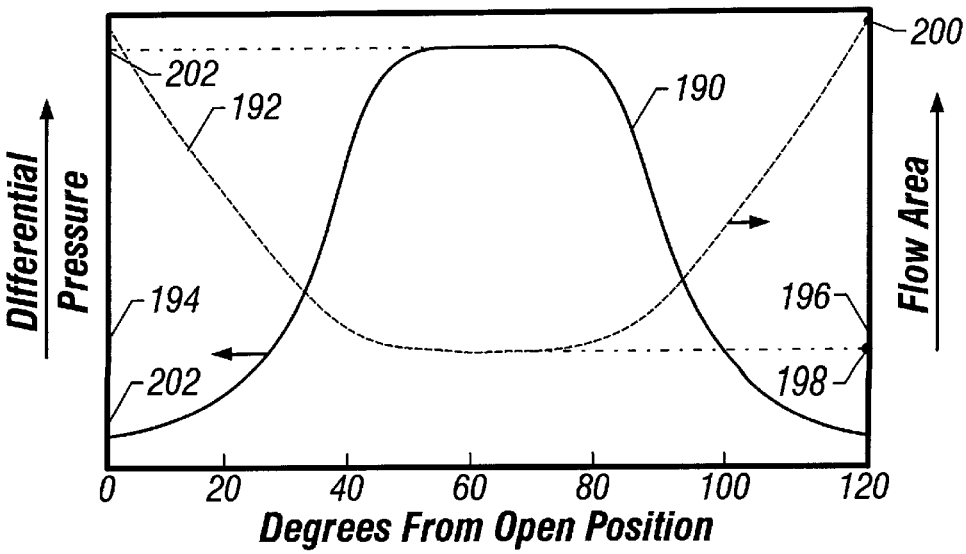
FIG. 10 shows the relationships between rotor position, differential pressure across the modulator device, and fluid flow area for the preferred embodiment of the invention.

FIG. 10 shows the relationship 190 between modulator rotor position and differential pressure across the modulator for the preferred embodiment of the invention as shown in FIGS. 8*a*–8*c* and FIGS. 9*a*–9*c*. FIG. 10 also shows the relationship 192 between rotor position and flow area for the preferred embodiment. The rotor-stator assembly again comprises three rotor blades spaced on 120 degree centers and three stator orifices also spaced on 120 degree centers. The number of degrees of the rotor from the fully "open" position is again plotted on the abscissa. The curve 190 represents differential pressure across the modulator on the left hand ordinate 194. The curve 192 represents fluid flow area through the modulator on the right hand ordinate 196. The extended time period of the pressure pulse at a maximum differential pressure 204 is clearly shown and results, as previously discussed, from the rotor 144 which "dwells" with a closed flow area 198 for a corresponding time period. The differential pressure drops to a value identified by the numeral 202 when the rotor moves so that the flow area is maximized at a value identified by the numeral 200.

In all embodiments of the invention set forth in this disclosure, a rotor comprising three blades and stators comprising three flow orifices have been illustrated. It should be understood, however, that the teachings of this disclosure are also applicable to stator-rotor assemblies comprising fewer or additional rotor blades and complementary stator flow orifices. As an example, the rotor can have "n" blades, where n is an integer. Each blade would then preferably centered around the rotor at spacings of 360/n degrees.

All illustrated embodiments illustrate either stator or rotor designs which yield the desired low closed flow aspect ratio and low closed flow area. It should be understood, however, that both stator and rotor can be constructed to obtain these design goals. As an example, the stator body can be fabricated with indentations in the flow orifices as shown in FIGS. 6*b* and 6*c*, and the rotor blades can be formed with notches which align with these indentations when the assembly is in a fully closed position.

It will be appreciated by those skilled in the art that there are yet other modifications that could be made to the disclosed invention without deviating from its spirit and scope as so claimed.

What is claimed is:

1. A pressure pulse generator for generating pulses in a flowing fluid, comprising:

(a) a housing adapted to be placed into said flowing fluid such that at least a portion of said flowing fluid will flow through said housing; and (b) at least one orifice within said housing defined by a flow conduit within a stator and the position of a rotor with respect to said stator, wherein said orifice has a minimum flow area defined by an aspect ratio and a minimum principal dimension; and wherein (i) said flow conduit and said rotor are constructed and arranged so that said aspect ratio is minimized and said minimum principal dimension is maximized for said minimum flow area, and (ii) said rotor rotates with respect to said stator and said flow conduit therein, thereby varying the area of said orifice, and creating periodic pressure pulses within said flowing fluid.

2. The pressure pulse generator of claim 1 wherein:

(a) said rotor comprises a plurality of rotor blades with a first radius;

(b) said stator comprises a plurality of flow conduits with a second radius larger than said first radius; and (c) the difference between said second radius and said first radius defines said orifice minimum principal dimension when each said rotor blade aligns with a corresponding flow conduit within said stator.

3. The pressure pulse generator of claim 1 wherein:

(a) said rotor comprises a plurality of rotor blades;

(b) each rotor blade has a port therein;

(c) a dimension of said port defines said orifice minimum principal dimension when each said rotor blade aligns with a corresponding flow conduit within said stator; and (d) said orifice minimum flow area is defined by a plurality of circles.

4. The pressure pulse generator of claim 1 wherein:

(a) said rotor comprises a plurality of rotor blades;

(b) said stator comprises a plurality of flow conduits, wherein each said flow conduit comprises a stator indentation;

(c) the dimensions of said stator indentation define said orifice minimum flow area when each said rotor blade aligns with a corresponding flow conduit within said stator.

5. The pressure pulse generator of claim 1 wherein:

(a) said position of said rotor with respect to said stator forms a gap;

(b) said gap remains constant independent of the rotational position of said rotor with respect to said stator; and (c) said orifice minimum flow area is configured as an approximately equilateral triangle.

6. The pressure pulse generator of claim 1 wherein the period between said periodic pressure pulses comprising pressure maxima and pressure minima is determined by the angular velocity of said rotor.

7. The pressure pulse generator of claim 2 wherein:

(a) said periodic pressure pulses comprise pressure maxima and pressure minima;

(b) the period between said pulses is determined by the angular velocity of said rotor; and (c) said pressure pulses dwell at said pressure maxima for a time determined by the angular velocity of said rotor.

8. The pressure pulse generator of claim 1, wherein:

(a) said pressure pulse generator is connected to a drill string;

(b) drilling mud flows downward within said drill string in a borehole, and upward within an annulus defined by said drill string and said borehole; and (c) said fluid comprises said drilling mud with particulate material suspended therein.

9. A method for generating pressure pulses within a flowing fluid, comprising:

(a) providing a pressure pulse generator comprising a rotor and a stator which cooperate to form a flow orifice for said fluid flow;

(b) rotating said rotor with respect to said stator thereby periodically varying said flow orifice between a maximum flow orifice and a minimum flow orifice;

(c) imparting a shear force to said fluid with the rotation of said rotor with respect to said stator;

(d) forming said stator and said rotor (i) to define an area of said minimum flow orifice, (ii) to maximize a minimum principal dimension of said minimum flow orifice for said area, (iii) to minimize the aspect ratio of said minimum flow orifice for said area; and (e) preventing jamming of said flow orifice by means of said shear force, said maximized minimum principal dimension, and said minimized aspect ratio.

10. The method of claim 9 further comprising:

(f) providing said rotor with a plurality of rotor blades with a first radius;

(g) providing said stator with a plurality of flow conduits with a second radius larger than said first radius; and (h) defining said minimum flow orifice with the difference between said second radius and said first radius and with each said rotor blade aligned with a corresponding flow conduit within said stator.

11. The method of claim 9 further comprising:

(f) providing said rotor with a plurality of rotor blades with a port in each blade; and (g) defining said minimum flow orifice with dimensions of said port and with each said rotor blade aligned with a corresponding flow conduit within said stator.

12. The method of claim 11 wherein said port is circular, and said minimum flow orifice is circular.

13. The method of claim 9 further comprising:

(f) providing said rotor with a plurality of rotor blades;

(g) providing said stator with a plurality of flow conduits, wherein each said flow conduit comprises an indentation;

(h) defining said minimum flow orifice with dimensions of said indentation and with each said rotor blade aligned with a corresponding flow conduit within said stator; and (i) configuring said stator and said rotor so that said minimum flow orifice is approximately square.

14. The method of claim 9 further comprising:

(f) spacing a face of said rotor from a face of said stator thereby forming a gap;

(g) configuring said rotor and said stator so that said minimum flow orifice is approximately triangular; and (h) defining said minimum flow orifice with a specified gap width.

* * * * *